US008591135B2

(12) United States Patent
Baker et al.

(10) Patent No.: US 8,591,135 B2
(45) Date of Patent: Nov. 26, 2013

(54) FILE BINDER AND DOCUMENT ORGANIZER

(76) Inventors: Jeff Baker, Orlando, FL (US); Mark Bunker, Orlando, FL (US); Seth Freytag, Orlando, FL (US); Kelly Tran, Orlando, FL (US); Paul van der Pol, Winter Garden, FL (US)

( * ) Notice: Subject to any disclaimer, the term of this patent is extended or adjusted under 35 U.S.C. 154(b) by 0 days.

(21) Appl. No.: 13/568,514

(22) Filed: Aug. 7, 2012

(65) Prior Publication Data

US 2013/0058705 A1 Mar. 7, 2013

Related U.S. Application Data

(63) Continuation-in-part of application No. 12/877,966, filed on Sep. 8, 2010, now Pat. No. 8,485,750.

(51) Int. Cl.

| | |
|---|---|
| ***B42F 3/00*** | (2006.01) |
| ***B42F 13/40*** | (2006.01) |
| ***B42F 13/00*** | (2006.01) |
| ***B42F 13/12*** | (2006.01) |

(52) U.S. Cl.
USPC ..... 402/73; 402/4; 402/70; 402/502

(58) Field of Classification Search
USPC ..... 402/4, 70, 73, 502; D19/27
See application file for complete search history.

(56) References Cited

U.S. PATENT DOCUMENTS

| | | | | |
|---|---|---|---|---|
| 5,947,279 | A * | 9/1999 | Lee et al. | 206/425 |
| 6,371,679 | B1 * | 4/2002 | Peleman | 402/73 |
| 6,431,779 | B1 * | 8/2002 | Moor et al. | 402/73 |
| 7,252,452 | B2 * | 8/2007 | Africa et al. | 402/73 |
| 2004/0165936 | A1 * | 8/2004 | Vincent | 402/73 |
| 2008/0304901 | A1 * | 12/2008 | Seman | 402/70 |
| 2012/0099921 | A1 * | 4/2012 | Sada et al. | 402/70 |

* cited by examiner

*Primary Examiner* — Kyle Grabowski
(74) *Attorney, Agent, or Firm* — Timothy H. Van Dyke; Beusse, Woleer, Sanks, Mora & Maire, P.A.

(57) ABSTRACT

Disclosed herein is an organizer comprising a unique structural configuration to house and store both non-perforated documents and perforated documents. The organizer comprises a ring binder that is associated with an expandable compartment that is arranged peripheral to the ring binder.

6 Claims, 8 Drawing Sheets

FILE BINDER AND DOCUMENT ORGANIZER

CROSS-REFERENCE TO RELATED APPLICATIONS

This application claims priority to and is a Continuation-In-Part of U.S. application Ser. No. 12/877,966, filed Sep. 8, 2010 U.S. Pat. No. 8,485,750, which is incorporated herein by reference in its entirety.

BACKGROUND

People are required to manage many pieces of information in the course of a typical day, relating to appointments, errands, projects and responsibilities. In addition, a person has goals and other personal matters which need to be incorporated into the planning of one's day in order for them to be realized. Besides the recurring and/or ordinary pieces of information an individual must track and record (which can clutter a person's mind or workplace), it is necessary to make note of new and important ideas lest they be forgotten. In general, having to remember a great many pieces of information tends to make a person feel overwhelmed and therefore, less productive and creative.

Wire bound or spiral bound notebooks have been on the market for many years. Conventionally, the wire bound notebook includes a pair of separate cover members which include wire receiving holes or perforations along their inner edges and along the inner edges of loose leaf sheets bound into the notebook. The wire is wound helically through the registered perforations of the discrete cover members and those of the pad of paper. Similarly, three-ring binders have been available for years that have a number of binding jaws that open and close to secure loose leaf paper. Both styles of binders require that the document being held must be perforated in order to have the wire or binding jaws engage the document.

U.S. Pat. No. 7,704,006 teaches a ring binder that contains an expandable pocket. Documents may be held in the slits provided in the expandable pocket. The expandable pocket is held in place and restrained by the binder covers and the zip able skirt.

The inventors have realized a number of new binder configurations that substantially increase storage of documents that must not be perforated and which allow increased efficiency in organizing all types of documents and related samples.

DETAILED DESCRIPTION

Figure 2:
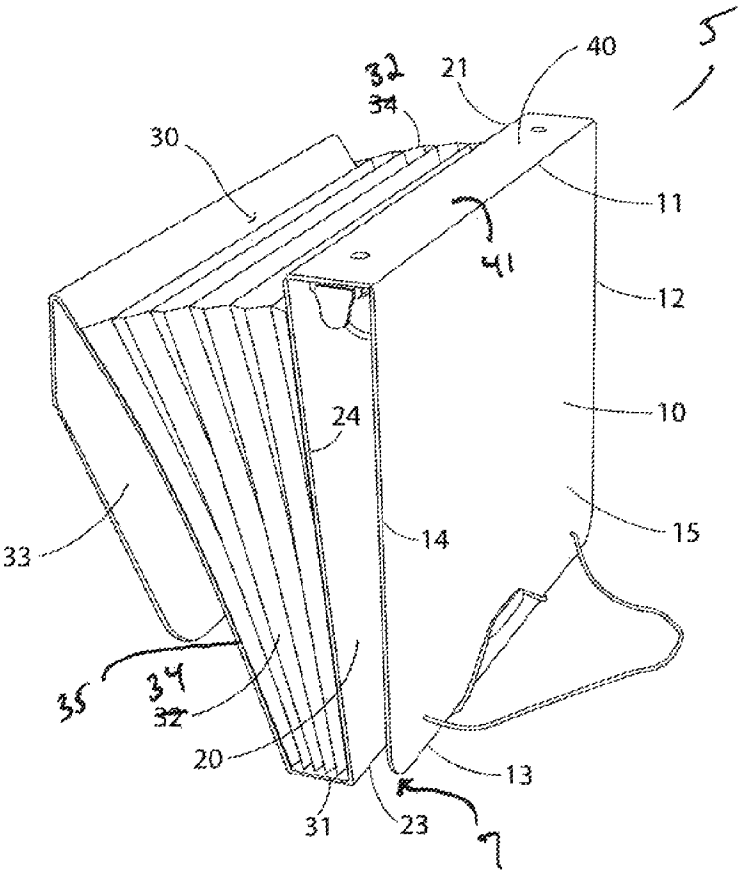
FIG. 2 shows a side perspective view of the embodiment shown in FIG. 1 with the expandable compartment in an opened position.

The inventors have realized that many business and scholastic activities require the organization of both structural information, which has a fixed sequence and a unstructured information which does not have a fixed sequence. A binder is a good tool to keep structured information while a file folder is a good tool to keep unstructured information. According to certain aspects of the present invention, the invention enables the storage and organization of structured and unstructured information securely together in one place.

According to a first embodiment, the invention pertains to an organizing binder that includes a first planar cover member and a second planar cover member. The first and second planar cover members each include an outer surface, an inner surface, a proximal edge, a distal edge, a top edge and a bottom edge. The embodiment also includes a bridge member that has a planar bridge body portion. The body portion includes a bridge inner surface, a bridge outer surface, a first bridge outer edge and a second bridge outer edge. The first bridge outer edge associates with the first planar cover member proximal edge and the second bridge outer edge associates with the second planar member proximal edge. The term "associate(s)", or forms thereof, with respect to different elements of an inventive embodiment includes a direct or indirect engagement or integration amongst the elements. The embodiment also includes a binding mechanism associated with the bridge inner surface. The binding mechanism includes a plurality of binding members that move from a released state to binding state. The embodiment also includes an outwardly expanding compartment associated with the first planar cover member outer surface. The expandable compartment includes a first wall portion, a second wall portion, and an optional third wall portion spanning between an compartment outer cover and the first planar cover member outer surface. The first, second, or third wall portions, or a combination thereof, have excess material that enables expansion of the compartment outer cover away from the first planar cover member outer surface.

In a more specific embodiment, the aforementioned first, second or third wall portions, or combination thereof include a series of folds. In an even more specific embodiment, the expandable compartment includes two or more separate slits into which material may be separately stored.

With reference to other specific embodiments that have an expandable compartment, the binder further includes a compartment flap that moves from an open position, where material in the expandable compartment may be accessed, to a closed position, where material in said expandable compartment is inaccessible. According to one example, the compartment flap includes a compartment flap first end that is associated with the bridge member and a compartment flap second end that is secured to the compartment outer cover. According to another example, the compartment flap includes a compartment flap first end that is associated with the compartment outer cover and a compartment flap second end that is secured to the second planar member outer surface. In yet another example, the compartment flap includes a compartment flap first end that is associated with the first planar outer surface and a compartment flap second end that is secured to the compartment outer cover.

According to another embodiment, the binder includes a latching means for securing a compartment flap. The latching means may take several forms and configurations, that will be apparent to those skilled in the art equipped with the teachings herein. In no way intended to be limiting, examples of latching means, include but art not limited to, hook and loop fabric adhered to the compartment flap, a catching member that grabs a stretchable cord, a snap, a button/slit configuration, a clip, a zipper, or a magnet. Depending on the version or example of the inventive binder embodiment, a portion of the latching means will typically be associated with the compartment flap that interacts with another portion of the latching mechanism that is associated with the binder at a separate location.

According to another embodiment, the invention pertains to a binder that includes an outwardly expanding compartment along with retractable hanging members. The retractable hanging members will support and carry the binder on a support frame, such as those typically found in filing cabinets. The retractable hanging members may include a first set of hanging members that are configured to extend in a first end direction and a second set of hanging members that extend in a second end direction. When the retractable hanging members are in a closed state, they are generally unexposed from the binder and when in an open state, they are exposed and ready for supporting the binder.

The hanging members can be placed at different selected locations of the binder. For example, one hanging member may be placed on the first planar cover member and another hanging member placed on the second planar cover member, or compartment outer cover. Typically, a set of two or more hanging members are arranged at a first end of the binder and a set of two or more hanging members are arranged at a second end of the binder. In a specific embodiment, the set of hanging members extend out the end of the binder in a parallel fashion. In a specific embodiment, the hanging member includes an elongated body portion, a distal end, a tab at the distal end, and an indention defined at the distal end. The indentation and the tab assist in retaining the binder on a support device.

Figure 1:
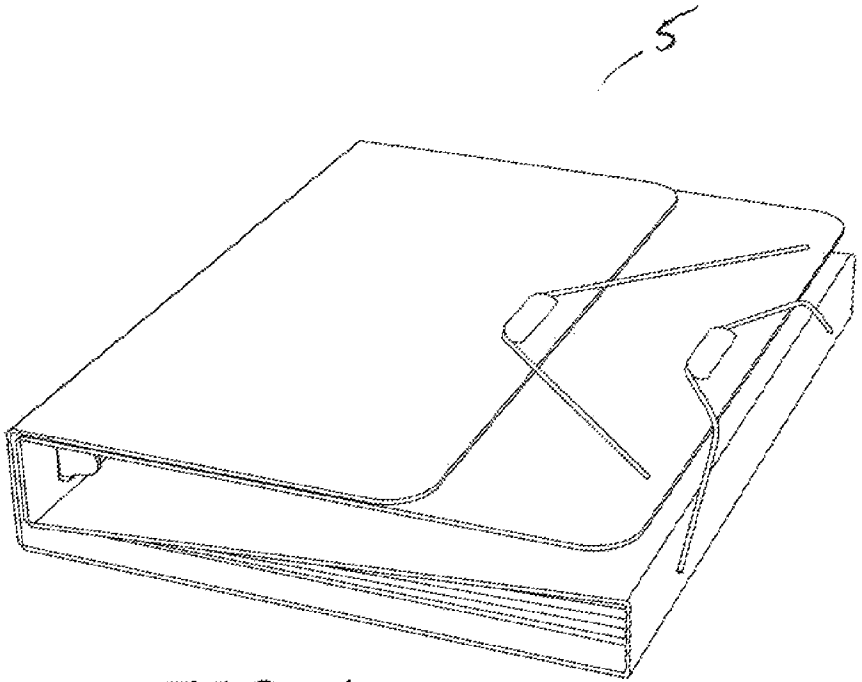
FIG. 1 shows a side perspective view of an embodiment of the invention.

Turning now to the drawings, FIGS. 1 and 2 show a side perspective view of an organizing binder embodiment 5. FIG. 2 shows the embodiment 5 with an expandable compartment 30 in an opened position. The organizer 5 includes a ring binder 7 that comprises a first planar cover member 10 with a proximal edge 11, a first end edge 12, a distal edge 13, a second end edge 14, and a top surface 15. Associated with the proximal edge 11 of the first planar cover member 10 is a bridge member 40. The bridge member has an outer surface 41. The ring binder 7 also includes a second planar cover member 20 having a proximal edge 21. The second planar cover member 20 is associated with the bridge member 40 at proximal edge 21. The second planar cover member 20 has a second end edge 24.

Figure 4:
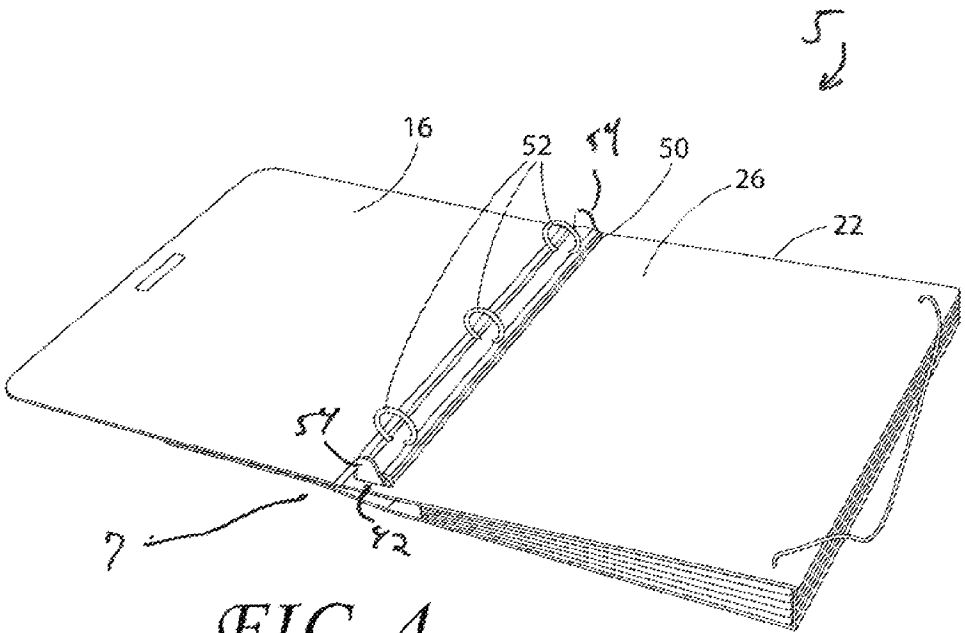
FIG. 4 shows a bottom perspective view of the embodiment shown in FIGS. 1-3 with a binder in an opened position.
Figure 3:
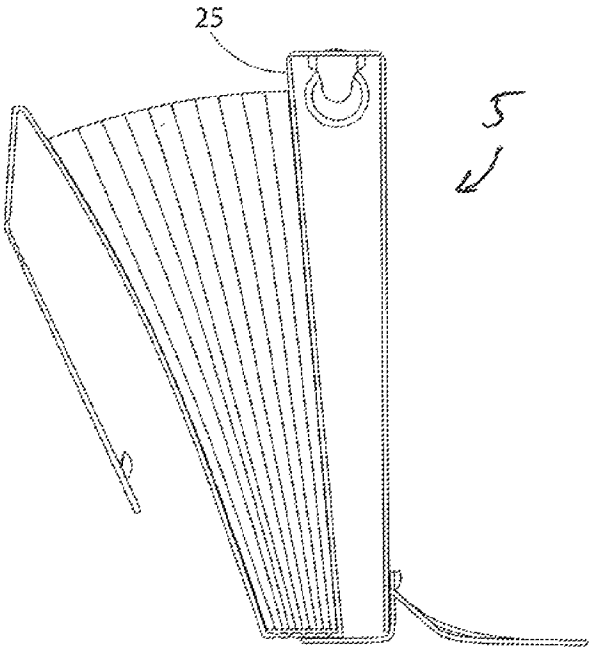
FIG. 3 shows a side view of the embodiment shown in FIGS. 1 and 2.

FIG. 3 shows an end view of the embodiment 5 that reveals second planar cover member outer surface 25. FIG. 4 shows an end perspective view of the embodiment 5 with the binder 7 in an opened position to reveal a first planar cover member inner surface 16, a second planar cover member inner surface 26 and a first end edge 22 of the second planar cover member 20. The bridge member inner surface 42 is revealed in FIG. 4 as well. Associated on the inner surface 42 of the bridge member 41 is a binder mechanism 50 having a plurality of binding members 52. The binder members 52 are opened and closed by manipulating actuators 54.

Returning to FIG. 2, the embodiment 5 also includes an expandable compartment 30 that has a first wall portion 32 and a second wall portion 34. Associated with the first and second wall portions is a compartment outer cover 35. As shown, the first and second wall portions 32, 34 fold in an accordion-like fashion. Those skilled in the art will appreciate that the walls 32, 34 may take numerous different configurations and/or made of different materials. For most typical embodiments, it is important for the functionality of the walls that there be a supernumerary amount of material so as to enable expansion of the walls 32, 34 that in turn separates at least part of the compartment outer cover 35 away from the second planar cover member outer surface 25. Associated with the compartment outer cover 35 is a compartment flap 33. The compartment flap 33 is shown in an open position. As will be discussed in further detail below, the organizer binder 5 may be stored in a file cabinet or similar storage device. Depending on the desires of the user, the organizer can be stored with the compartment flap in an opened position or in a closed position as shown in FIG. 1. At an end opposing the compartment flap, the compartment outer cover 35 is associated with a compartment bridge portion 31. As shown, the compartment bridge portion 31 also associates with the second bridge cover member 20.

Figure 6:
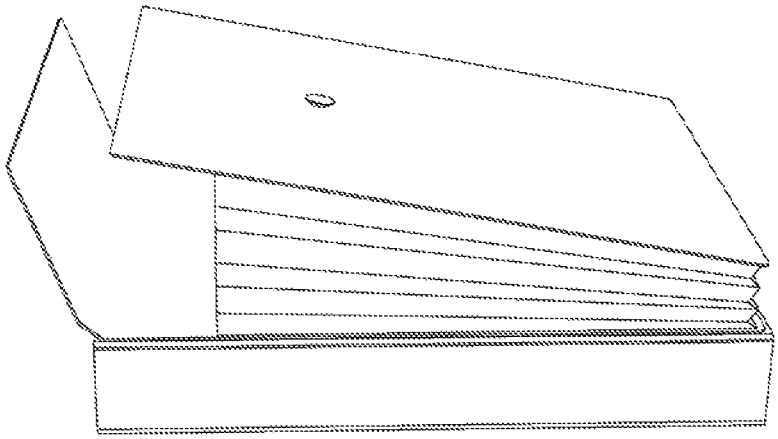
FIG. 6 shows a side perspective view of the embodiment shown in FIG. 5 with an expandable compartment in an opened position.
Figure 5:
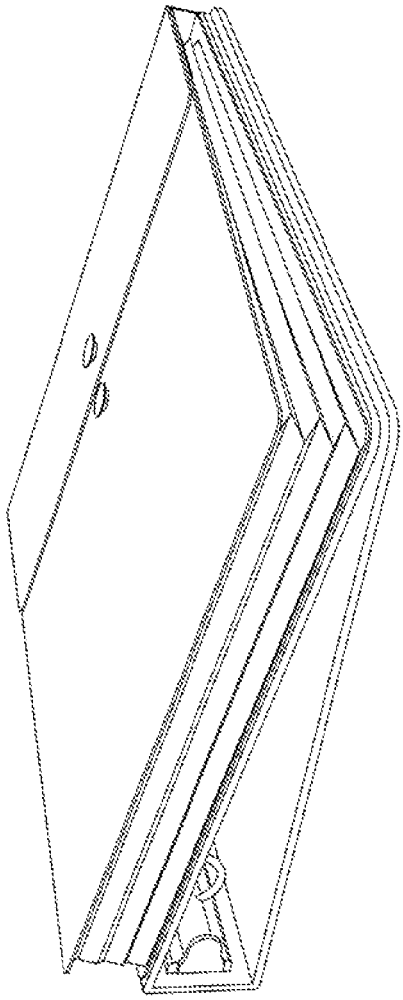
FIG. 5 shows a bottom perspective view of another embodiment of the invention.
Figure 8:
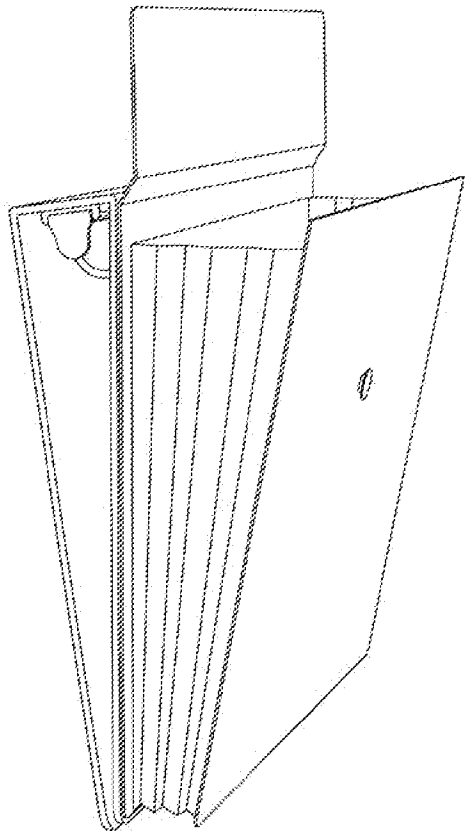
FIG. 8 shows a side perspective view of the embodiment shown in FIG. 7 with an expandable compartment in an opened position.
Figure 7:
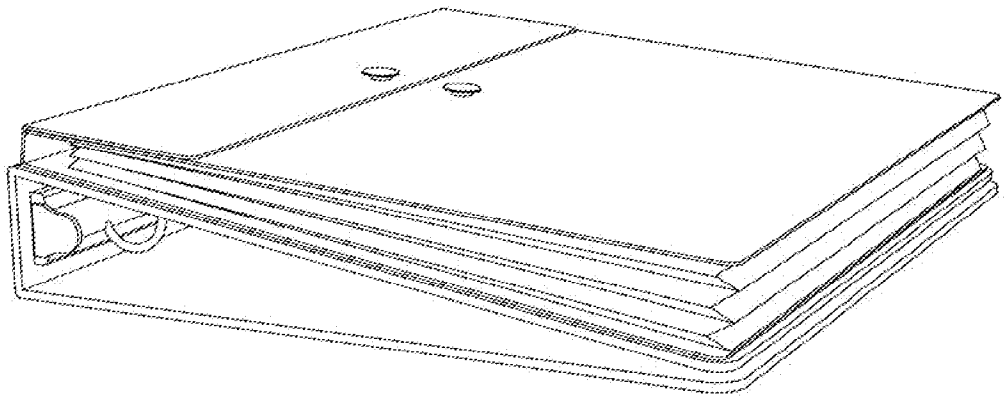
FIG. 7 shows a bottom perspective view of another embodiment of the invention.

FIGS. 5 & 6 show an alternative embodiment of an organizing binder. The arrangement shows an expandable compartment vertically aligned with respect to the ring binder. FIGS. 7 & 8 show an alternative embodiment with an expandable compartment aligned horizontally on the ring binder.

Figure 10:
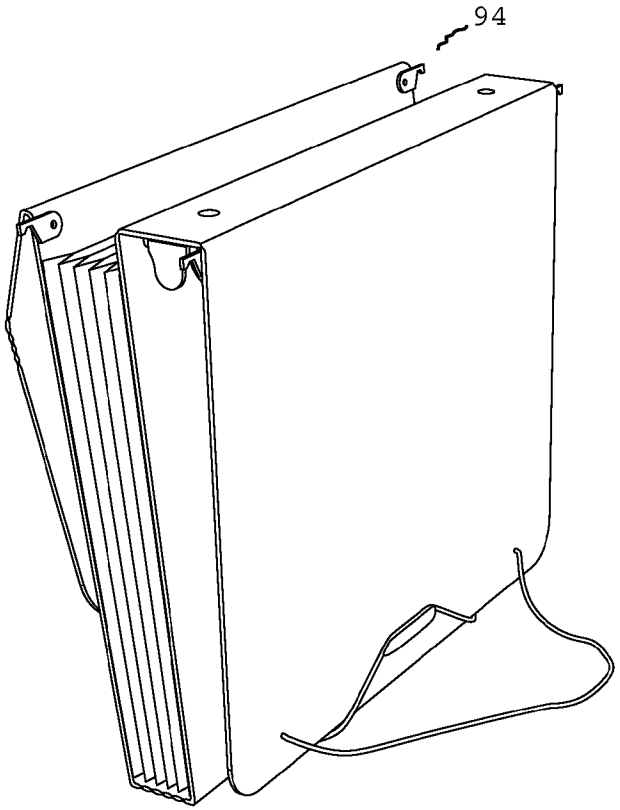
FIG. 10 shows a side perspective view of the embodiment shown in FIG. 9 with a compartment flap held in an opened position.
Figure 9:
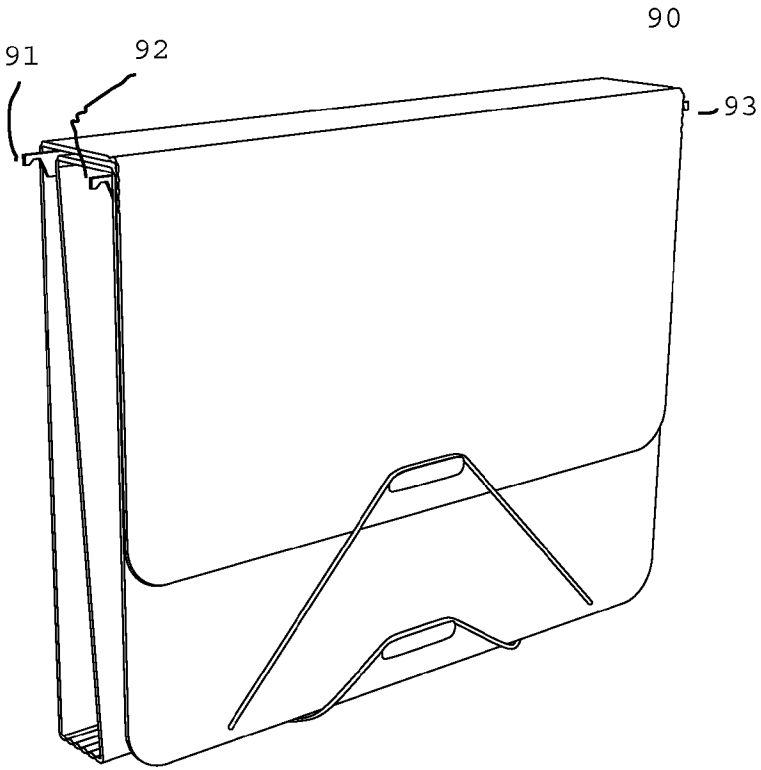
FIG. 9 shows a side perspective view of an embodiment that comprises hanging members.

FIG. 9 shows an embodiment 90 similar to that shown in FIG. 1, which includes hanging members 91, 92, and 93. FIG. 10 shows the embodiment of 90 with the compartment flap in an opened position. FIG. 10 also reveals hanging member 94. It is noted that the hanging members 91-94 are arranged and placed such that they can support the embodiment 90 whether the compartment flap is open or closed.

Figure 11:
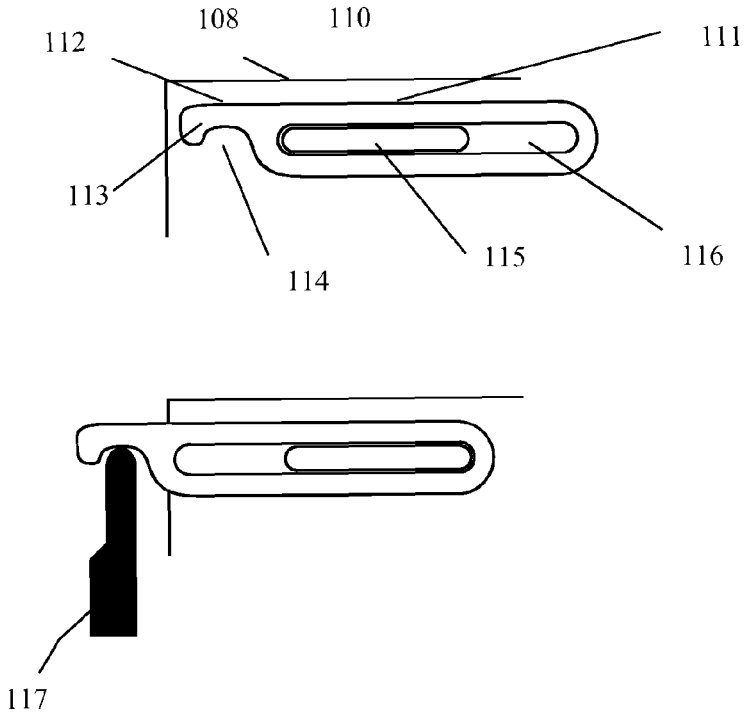
FIG. 11 shows a depiction of a hanging member embodiment.

FIG. 11 shows a hanging member embodiment 110 attached to a surface 108 of a binder. The hanging member 110 is shown in a retracted position (top) and an extended position (bottom). The hanging member 110 includes an elongated body portion 111 with a tab 113 disposed on a distal end 112 thereof. Defined on the distal end 112 is an indentation 114 to assist in retaining the binder. Defined within the elongated body portion 111 is a slot 115 that slides on a projection 116. The extended hanging member 110 rests on a rail 117 typically found in a hanging file cabinet.

Figure 12:
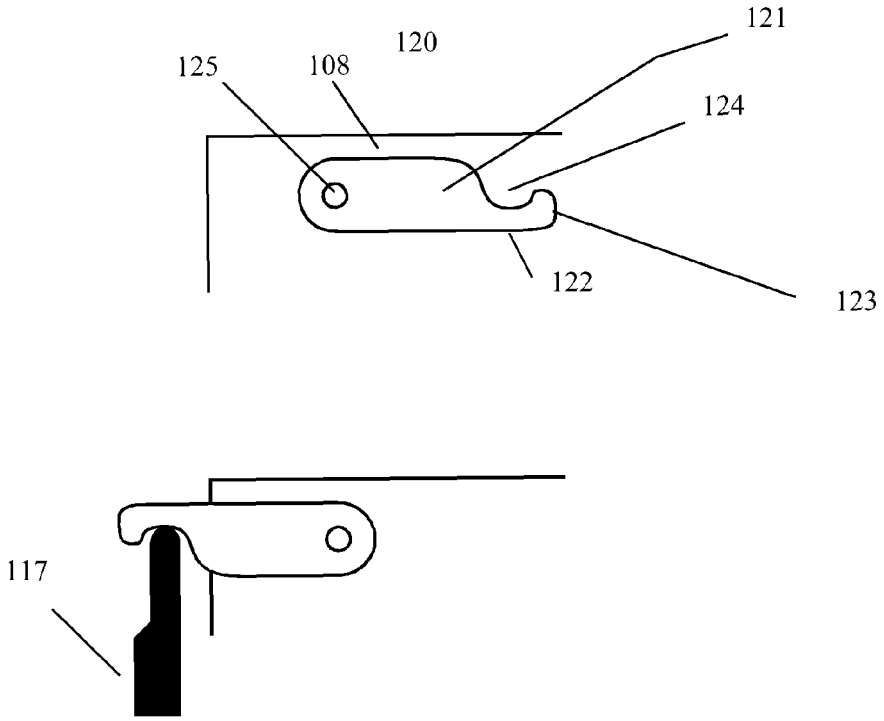
FIG. 12 shows a depiction of a hanging member embodiment.

FIG. 12 shows a hanging member embodiment 120 attached to a surface 108 of a binder. The hanging member 120 is shown in a retracted position (top) and an extended position (bottom). The hanging member 120 includes an elongated body portion 121 with a tab 123 disposed on a distal end 122 thereof. Defined on the distal end 122 is an indentation 124 to assist in retaining the binder. The hanging member 120 pivots around pin 125. The extended hanging member 120 rests on a rail 117 typically found in a hanging file cabinet.

Documents are typically stored on a shelf or in a hanging file folder cabinet. File folder cabinets typically include rails onto which hanging files can be hung. Embodiments of the present invention accommodate both a shelf or in a hanging file folder cabinet. In addition, if a device of the present invention is stored in a file folder cabinet, it can be stored fully closed or with the expandable compartment section open. To achieve this, the hangers are operably attached to a binder embodiment in a fashion that it enables the organizer to stored with the expandable compartment section in either an open position or in a closed position without interfering with the hanging function of the hanging members. The hanging members are configured such that they are secured in a lateral direction on rails of a file folder cabinet.

Figure 13:
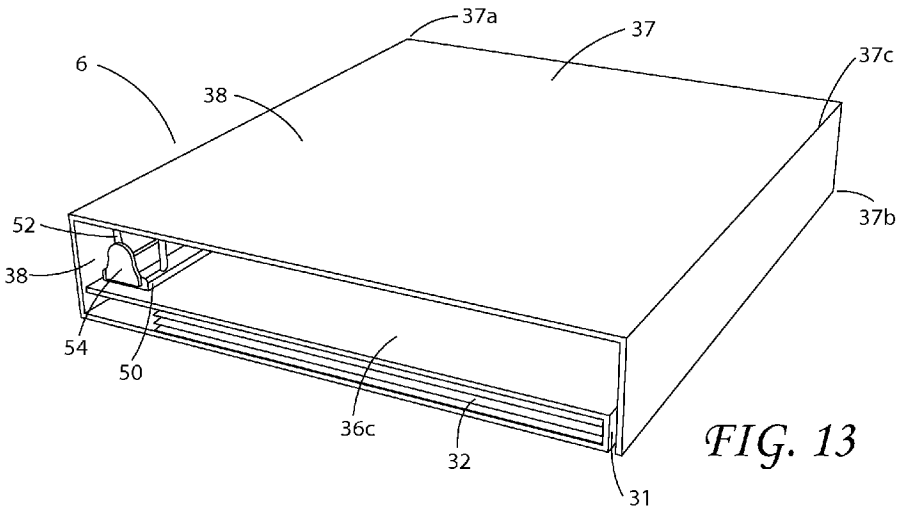
FIG. 13 shows a bottom perspective view of another embodiment of the invention.
Figure 14:
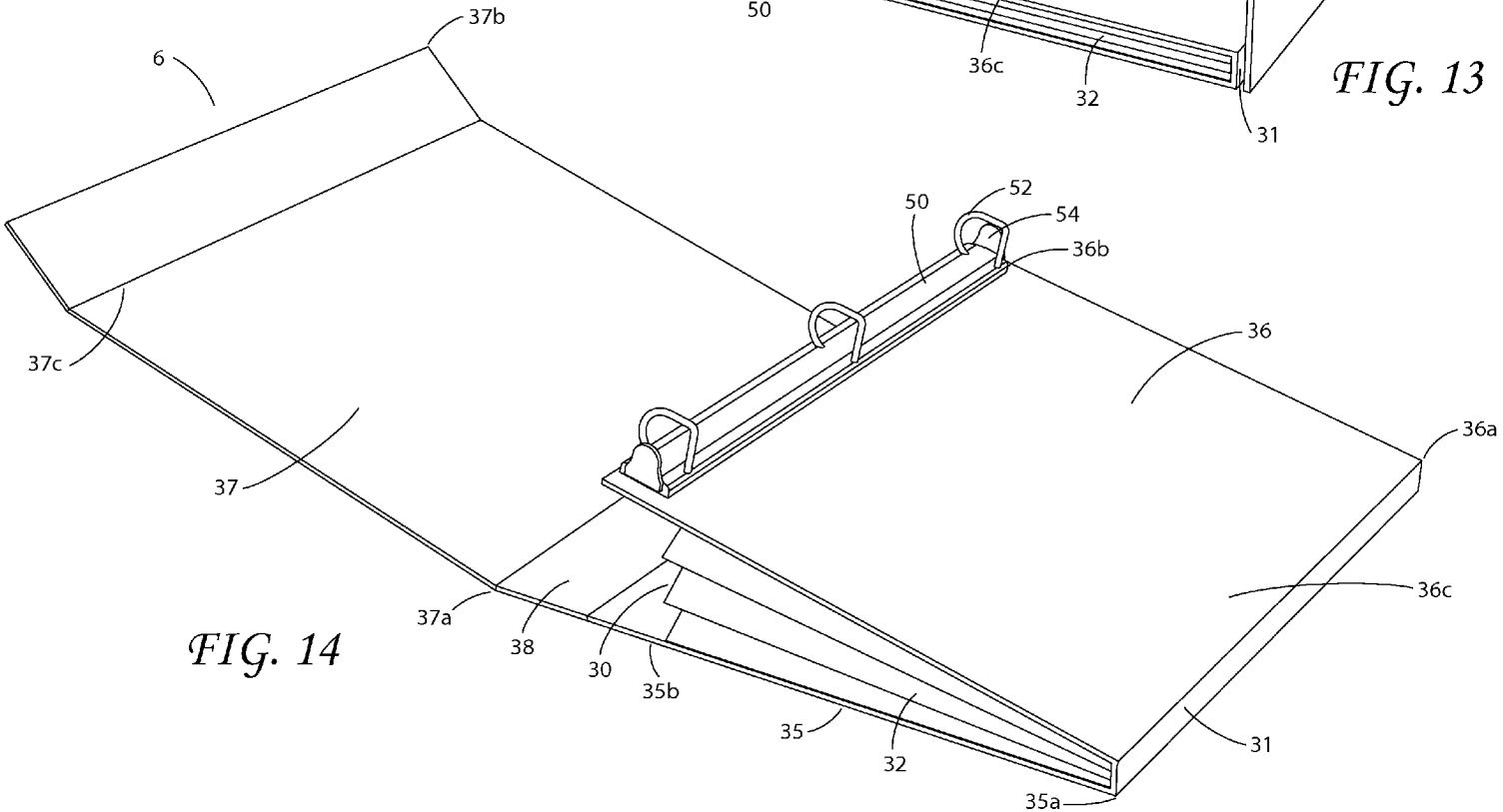
FIG. 14 shows a bottom perspective view of an embodiment of the invention shown in FIG. 13 with a binder and an expandable compartment in an open position.

An embodiment of a binder 6 presented in FIGS. 13-14 of the present invention is similar in some respects to the embodiment shown in FIGS. 9-10. As in other specific embodiments that have an expandable compartment, the binder 6 further includes a compartment flap 37 that moves from an open position as shown in FIG. 14, where material in the expandable compartment 30 may be accessed, to a closed position as shown in FIG. 13, where material in said expandable compartment 30 is inaccessible. In one embodiment, the expandable compartment 30 is formed of a compartment outer cover 35 and a compartment inner cover 36. The compartment outer cover 35 includes a first end 35*a* and a second end 35*b*, and the compartment inner cover 36 includes a first end 36*a* and a second end 36*b*. The first end of the compartment outer cover 35*a* and the first end of the compartment inner cover 36*a* are secured to a compartment bridge portion 31 which forms the base for the expandable compartment 30. The expandable compartment 30 includes a first wall portion and a second wall portion, each of the wall portions span between the compartment outer cover and the compartment inner cover. The first and second wall portions, or a combination thereof, comprise supernumerary material so as to allow expansion of the compartment inner cover away from the compartment outer cover.

According to one example, the compartment flap 37 includes a compartment flap first end 37*a* that is associated with an outer cover bridge member 38 and secured to the compartment outer cover 35 via the outer cover bridge member 38. When the binder 6 is in a closed position, the outer cover bridge member 38 is situated over the opening of the expandable compartment 30.

The compartment flap 37 comprises a compartment flap fold 37*c* of the compartment flap 37 near a compartment flap second end 37*b*. The distance between the compartment flap second end 37*b* and the compartment flap fold 37*c* may vary based on the size of the binder 6. There may be more than one fold provided in the compartment flap. A portion of or the entire area of the compartment flap 37 between the compartment flap fold 37*c* and the compartment flap second end 37*b* may include a latching means such as Velcro, magnet, snap enclosure, a button/slit configuration, a clip or a zipper, for example, as described above such that it can be removably secured to the compartment bridge portion 31 when the binder is in a closed position as in FIG. 13.

In an embodiment, the compartment bridge portion 31 may also be equipped with a complementary latching means such that when the binder is in a closed position, the portion of the compartment flap 37 between the compartment flap fold 37*c* and the compartment flap second end 37*b* will be removably secured to and superimposed over the compartment bridge portion 31, and the expandable compartment 30 will be inaccessible.

The binder also includes a binding mechanism 50 as in some specific embodiments described above complete with binder members 52 which are opened and closed by manipulating actuators 54. However, in contrast to the embodiments disclosed above, in the binder 6 embodiment, the binding mechanism 50 is disposed on an outer side of the compartment inner cover 36. In a particular embodiment, the binding mechanism 50 is disposed along a second end 36*b* of the compartment inner cover, such that when the binder 6 is in a closed position as in FIG. 13, binding mechanism 50 is also inaccessible. The binding mechanism 50 may alternatively be disposed adjacent to the second end of the compartment inner cover 36*b*. In other embodiments, the binding mechanism 50 may be disposed on the compartment inner cover 36 at a position within half the length of the compartment inner cover 36 from the compartment inner cover second end 36*b*, or it may be disposed at a position within one third of the length of the compartment inner cover 36 from the compartment inner cover second end 36*b*.

The term adjacent as used herein refers to placement directly on or near by in space or position, it also includes adjoining with or without intervening space. Adjacent also includes being contiguous with or having a common boundary.

Figure 15:
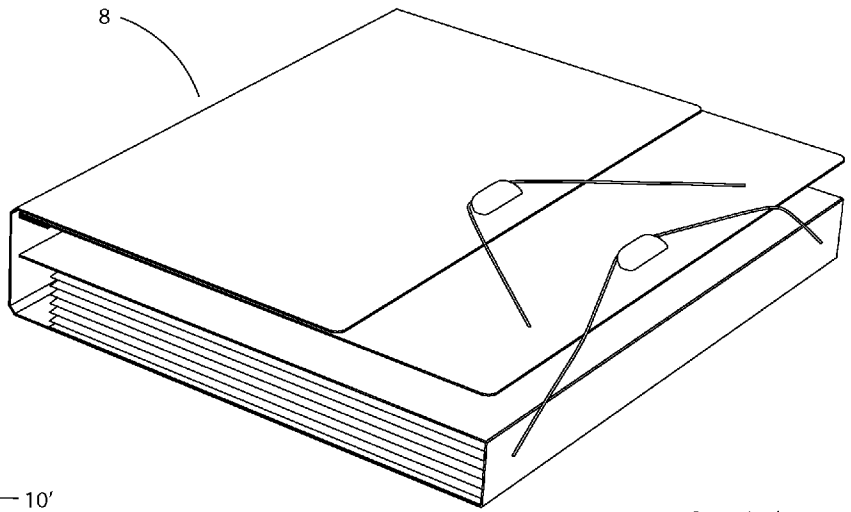
FIG. 15 shows a side perspective view of another embodiment of the invention.
Figure 16:
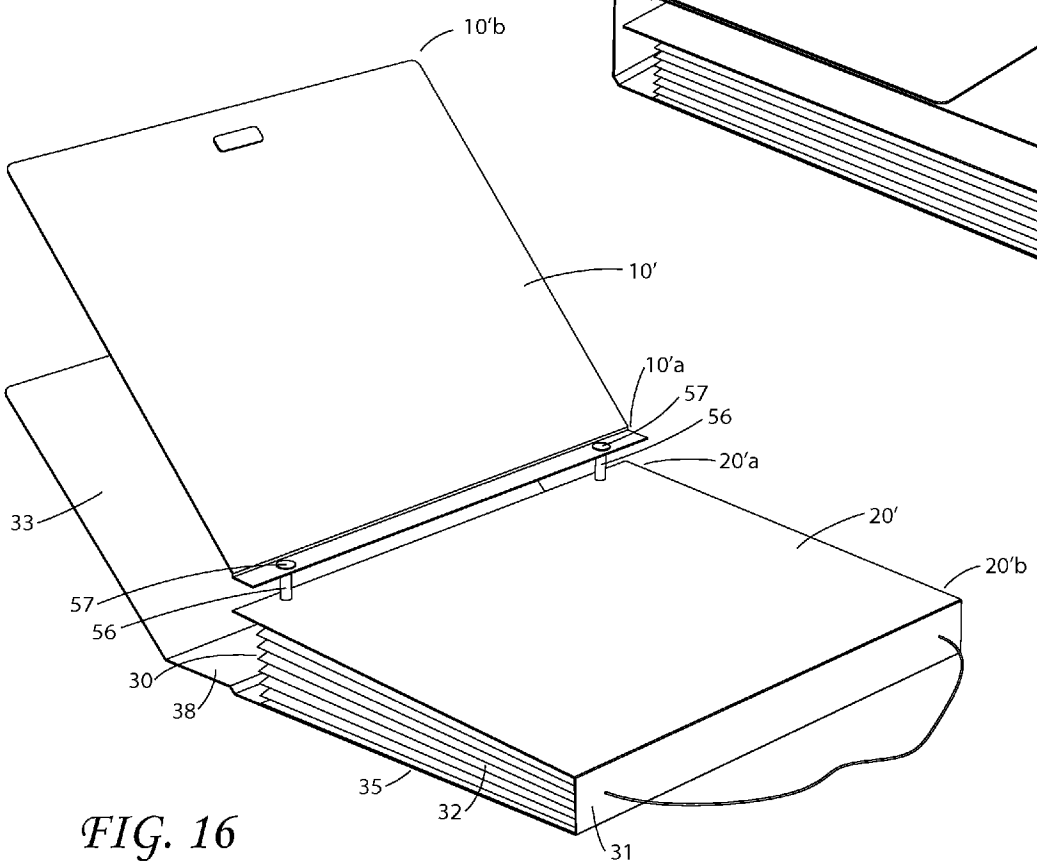
FIG. 16 shows a side perspective view of the embodiment of FIG. 15, in an open position.

The term superimposes, as used herein, includes where for example, a first material is placed or laid over a second material, and includes where the first material completely or partially covers the second material. An embodiment of a binder 8 presented in FIGS. 15-16 of the present invention is similar in some respects to the embodiment shown in FIGS. 1-2. However, instead of providing a binder 7 as in the embodiment 5 of FIGS. 1-2, the embodiment 8 provides the first planar cover member 10' which is associated with the second planar cover member 20', wherein openings may be provided in the proximal end of the first planar cover member 10'a which align with the openings in the proximal end of the second planar cover member 20'a such that a securing member can be used to secure the first planar cover member 10' to the second planar cover member 20'. For example, a post 56 or other similar device known in the art may be inserted through the openings of the first planar cover member 10' and the second planar cover member 20' to bind the first and second planar cover members 10', 20' together. The posts 56 can be embodied, for example, as in U.S. Patent Publication 2007/0041783 A1 by Seymour, such that loose leaf papers or other documents with openings which align with the posts can be inserted into and held within the binder embodiment 8 by posts 56. Each post 56 is fastened to the second planar member 20' and first planar member 10' via a first plate 57 and a second plate 58 (not shown in FIGS). The first planar cover member 10' and the compartment flap 33 can be closed and secured, rendering the binder embodiment 8 in the closed position as is presented in FIG. 15 and in the embodiment shown and described in FIGS. 1-2 above.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment. Furthermore, each individual component of any given assembly, one or more portions of an individual component of any given assembly, and various combinations of components from one or more embodiments may include one or more ornamental design features.

The invention claimed is:

1. An organizing binder comprising a compartment outer cover and a compartment inner cover, each of said compartment outer cover and compartment inner cover comprising a first end and a second end, an outer surface and an inner surface;

a compartment bridge portion comprising a planar bridge body portion having a bridge inner surface, a bridge outer surface, a bridge inner edge and a bridge outer edge, wherein the bridge outer edge associates with the compartment inner cover first end, and wherein the bridge inner edge associates with the compartment outer cover first end;

an expandable compartment comprising a first wall portion and a second wall portion, each of said first and second wall portions spanning between the compartment outer cover and the compartment inner cover, wherein said first and second wall portions, or a combination thereof, comprise supernumerary material so as to allow expansion of said compartment outer cover away from said compartment inner cover;

a compartment flap that moves from an open position, where material in said expandable compartment may be accessed, to a closed position, where material in said expandable compartment is inaccessible, said compartment flap comprising a compartment flap first surface that is associated with the second end of the compartment outer cover, and a compartment flap second surface which superimposes the compartment bridge portion when the binder is in a closed position; and a binding mechanism disposed on the outer surface of the compartment inner cover.

2. The binder of claim 1, wherein the binding mechanism is disposed at the second end of the compartment inner cover.

3. The binder of claim 1, wherein an outer cover bridge member is disposed between the compartment flap first surface and the compartment outer cover second end.

4. The binder of claim 1, wherein the binding mechanism is disposed adjacent to the second end of the compartment inner cover.

5. The binder of claim 1, wherein the binding mechanism is disposed on the compartment inner cover at a position within half the length of the compartment inner cover from the compartment inner cover second end.

6. The binder of claim 1, wherein the binding mechanism is disposed on the compartment inner cover at a position within one third of the length of the compartment inner cover from the compartment inner cover second end.

* * * * *